US005332897A

United States Patent [19]

Stobbe et al.

[11] Patent Number: 5,332,897

[45] Date of Patent: Jul. 26, 1994

[54] UNIVERSAL ELECTRODE FOR CORONA DISCHARGE SURFACE TREATING

[75] Inventors: Bruce D. Stobbe, Winsted; Ronald L. Seaman, New Hartford; Richard S. Prechtl, Simsbury; William S. Bednarcyk, Winsted, all of Conn.

[73] Assignee: Corotec Corporation, Collinsville, Conn.

[21] Appl. No.: 23,281

[22] Filed: Feb. 26, 1993

[51] Int. Cl.[5] ..... H01T 19/04

[52] U.S. Cl. ..... 250/305; 250/324

[58] Field of Search ..... 250/325, 324, 326; 361/233

[56] References Cited

U.S. PATENT DOCUMENTS

| | | | |
|---|---|---|---|
| 3,397,136 | 8/1968 | Balogh | 250/324 |
| 3,684,364 | 8/1972 | Schmidlin | 250/325 |
| 4,556,795 | 12/1985 | Tietje | 250/324 |
| 4,564,759 | 1/1986 | Tietje | 250/324 |
| 4,636,640 | 1/1987 | Majewski | 250/324 |
| 4,684,803 | 8/1987 | Collins | 250/325 |

*Primary Examiner*—Bruce C. Anderson

*Attorney, Agent, or Firm*—Seidel, Gonda, Lavorgna & Monaco

[57] ABSTRACT

A corona discharge surface system for treating both conductive and non-conductive materials is disclosed. The system comprises one or more universal electrodes each of which comprises first electrode means configured for corona discharge treatment of non-conductive materials and second electrode means configured for corona discharge treatment of conductive materials. The one or more universal electrodes are arranged on a common support with the combined structure having a pivot point about which the common support is pivotable. In one embodiment, the corona discharge device is used for the treatment of continuous webs of film materials that are moved by one generally cylindrical electrode mounted for rotation about a central axis thereof. The common support is fixed but pivotable so that the first electrode means is configured for corona discharge treatment of non-conductive film materials and the second electrode means is configured for corona discharge treatment of conductive film materials. The common support means has its pivot point disposed parallel to and spaced apart from the central axis of the generally cylindrical electrode. The common support is pivotable for selectably positioning a selected one of the first and second electrodes in spaced corona discharge treatment relation to the generally cylindrical electrode, thereby defining a gap between the generally cylindrical electrode and the selected one of the first and second electrode means for the passage of materials to be treated.

44 Claims, 9 Drawing Sheets

UNIVERSAL ELECTRODE FOR CORONA DISCHARGE SURFACE TREATING

FIELD OF THE INVENTION

The present invention relates to corona discharge surface treating and, more particularly, to a universal electrode for the corona discharge treatment of both conductive and non-conductive materials.

BACKGROUND OF THE INVENTION

Systems for corona discharge surface treatment are known. Some prior art systems are disclosed in U.S. Pat. Nos. 4,556,795, 4,564,759, and 4,636,640. The systems disclosed in each of those patents has at least two opposed electrodes, one of which is a rotating roll, which moves a material to be treated (commonly in the form of a continuous web of film-like material) during its treatment. The rotating roll electrode may or may not have an insulating covering, called a "buffer dielectric," on its surface. The rotating roll electrode is most often opposed by a plurality of fixed electrodes that are adjustable relative to the rotating roller so as to establish a predetermined treatment gap therebetween through which the film being treated is moved.

The rotating roll and the fixed electrodes typically have a high AC voltage applied across them which creates a high voltage electrostatic field. Normally, the rotating roll electrode is grounded, with the fixed electrodes being connected to the high voltage side of the power supply. The high voltage field establishes a corona discharge between the electrodes. The surface of the film interposed between the rotating and fixed electrodes is thus subjected to the corona discharge. The corona discharge treatment results in the molecules on the surface of the film being modified so as to increase the wettability of the film which, in turn, makes the surface more amenable to receiving and retaining an applied coating, such as for example printing ink for printing indicia on the film.

There are primarily two types of fixed electrodes used in corona discharge treatment of film materials. These types are commonly referred to as "bare roll" electrodes and "conventional" electrodes. Conventional electrodes are usually used when the rotating roll electrode has its outer surface covered by the buffer dielectric. Conventional electrodes used in conjunction with an insulated roll electrode can corona discharge treat only non-conductive materials such as paper or plastic. In a bare roll system, the rotating roll electrode usually is not covered by a buffer dielectric (hence the term "bare"). Instead, in a bare roll system, the buffer dielectric is on the fixed electrode. A bare roll system is always used when conductive materials, such as metallized materials or foils, are to be corona discharge treated. While a bare roll system can also be used to treat non-conductive materials, it has inherent inefficiencies which make it a poor choice for treating some non-conductive materials.

In practice, it is often desired to change a corona discharge treating system for a "bare roll" system to a "conventional" system, or vice versa. This typically consumes an inordinate amount of time to remove one type of electrodes and then install and align the other type of electrodes. This includes production line down time, as well as personnel time. When changing from one system to the other, one type of fixed electrode must first be disconnected and removed, and then the other type of fixed electrode installed. After installation, the spacing between the fixed electrodes and rotating electrode must be checked and sometimes adjusted so as to provide proper clearance between the rotating roll and fixed electrodes. It is desirable to avoid inordinate production line down time and set up time.

Moreover, materials to be treated often have different widths that should be taken into account in order to provide for proper corona discharge treatment. For example, for proper treatment it is desired that the available energy from the high voltage power source be applied across the full width of the material being treated. As the width of the material is increased or decreased, the number of fixed electrodes across the width of the material must be correspondingly increased or decreased. It is desired to easily accommodate different widths of materials being treated.

Accordingly, it is one object of the present invention to provide means for easily accommodating different widths of materials that receive corona discharge treatment.

It is a further object of the present invention to provide means that accommodate separate electrodes, such as conventional and bare-roll electrodes, respectively, which do not require the disconnection or reconnection typically required for separate electrodes.

Another object of the present invention is to provide a corona discharge surface treating system having electrodes that are easily reconfigured so as to run either "bare roll" or "conventional" treatment processes.

Other objects, advantages and novel features of the present invention will become apparent in the following detailed description of the invention when considered in conjunction with the accompanying drawings.

SUMMARY OF THE INVENTION

The invention is directed to a universal electrode, and to a corona discharge device using the universal electrode, that is particularly suited for treating both non-conductive and conductive type materials.

The universal electrode comprised first electrode means configured for corona discharge treatment of non-conductive materials and second electrode means configured for corona discharge treatment of conductive materials. A plurality of universal electrodes are arranged within and supported by a common support frame member. The combination of the frame member and the plurality of universal electrodes has a pivot point about which the frame is pivotable.

The corona discharge device is used for the treatment of continuous webs of film materials that are moved past a generally cylindrical electrode mounted for rotation about a central axis thereof. The frame member has its pivot point disposed parallel to and spaced apart from the central axis of the generally cylindrical electrode. The frame member is pivotable about the pivot point for selectably positioning a selected one of the first and second electrodes in spaced corona discharge treatment relation to the generally cylindrical electrode, thereby defining a gap between the generally cylindrical electrode and the selected one of the first and second electrode means for the passage of materials to be treated therebetween.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
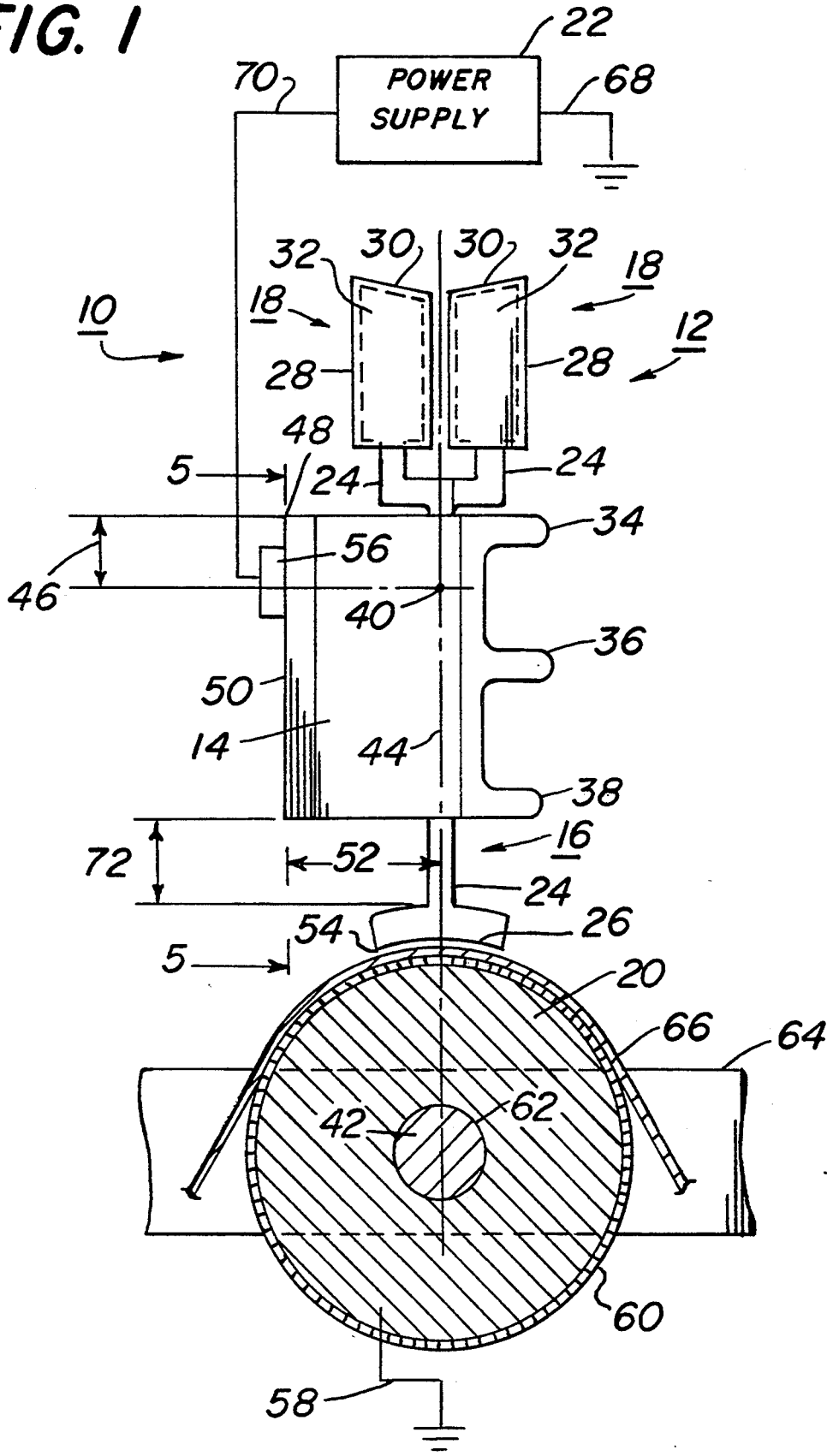
FIG. 1 is a schematic illustration showing a first of a series of universal electrodes of the present invention, situated for the treatment of non-conductive material.

FIG. 1 is a schematic illustration of a corona discharge surface treating system 10 comprising one or more universal electrodes 12 that are arranged within and supported by a common support means, such as frame 14. Each universal electrode 12 has a first end comprising a first electrode 16 and a second end comprising a second electrode 18. The first electrode is sometimes referred to as a "conventional electrode," and the second electrode 18 is sometimes referred to as a "bare-roll electrode." Each universal electrode 12 has only a single electrode 18, located in a staggered manner relative to immediately adjacent electrodes. The staggered, side-by-side arrangement of electrodes 18 will be further described hereinafter with reference to FIGS. 6 and 7. Furthermore, in the end view of FIG. 1, a single universal electrode 12 is visible, whereas in actuality (and as will be further described and as most clearly seen in FIG. 12) the system 10 comprises a plurality of such universal electrodes 12. The system 10 further comprises a rotating electrode 20, positioned opposite the universal electrodes 12, and a power supply 22.

The system 10 provides a corona discharge effect for treating either conductive materials, such as a foil or film of electrically conductive metallized material, or non-conductive materials, such as paper or plastic. The conductive or non-conductive material to be treated is commonly in the form of a continuous web that is moved past the rotating electrode 20. For the treatment of conductive or non-conductive material, a high voltage supplied by power source 22, commonly of the alternating current type, establishes a high voltage electrostatic field between the rotating electrode and either the one or more electrodes 16 or the one or more electrodes 18, with the material to be treated being interposed between the electrodes. The high voltage field establishes a corona discharge that causes the chemical composition of the surface of the material to be modified or to be oxidized which, in turn, improves selected characteristics of the surface of the material, such as its wettability, so that, for example, printed matter or an applied coating may be more advantageously adhered thereto. For such a modification, as is known to those skilled in the art, it is desired to raise the surface energy of the material being treated to a value sufficient to allow liquid substances, such as inks and coatings, to more readily adhere to the corona discharge treated surface.

The universal electrode 12 of the present invention allows the system 10 to treat non-conductive material with first electrode means 16 which is particularly suited for the treatment of non-conductive material, and also, at a different time, to advantageously treat conductive material with the second electrode means 18 which is particularly suited for the treatment of conductive material.

The first and second electrodes 16 and 18 are oppositely located on the frame member 14. Each of the first electrodes 16 has a conductive shank member 24 and a conductive operating face 26. Each of the second electrodes 18 has a hollow non-conductive, insulating member 28 having a non-conductive face 30. A conductive member 32 is disposed within the hollow non-conductive, insulating member 28. The conductive members 32 of the electrodes 18 are electrically connected to respective conductive shank members 24 of the electrodes 16 in a manner as will be described further below.

Figure 10:
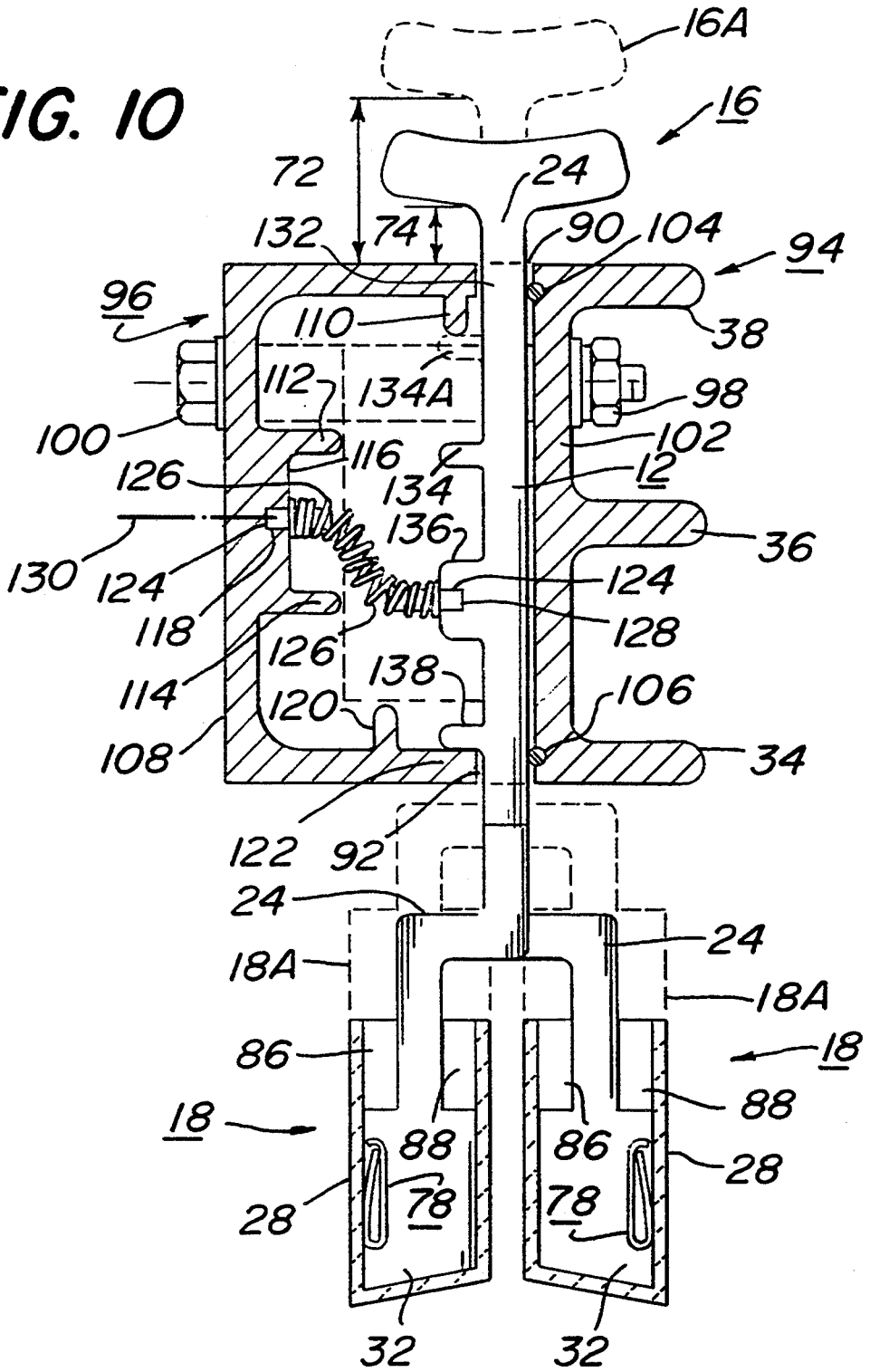
FIG. 10 illustrates some of the details of the frame member used for holding and supporting the universal electrodes, as well as illustrates an over-center spring bilateral mechanism used for snapping the universal electrode into and out of its operational positions.
Figure 11:
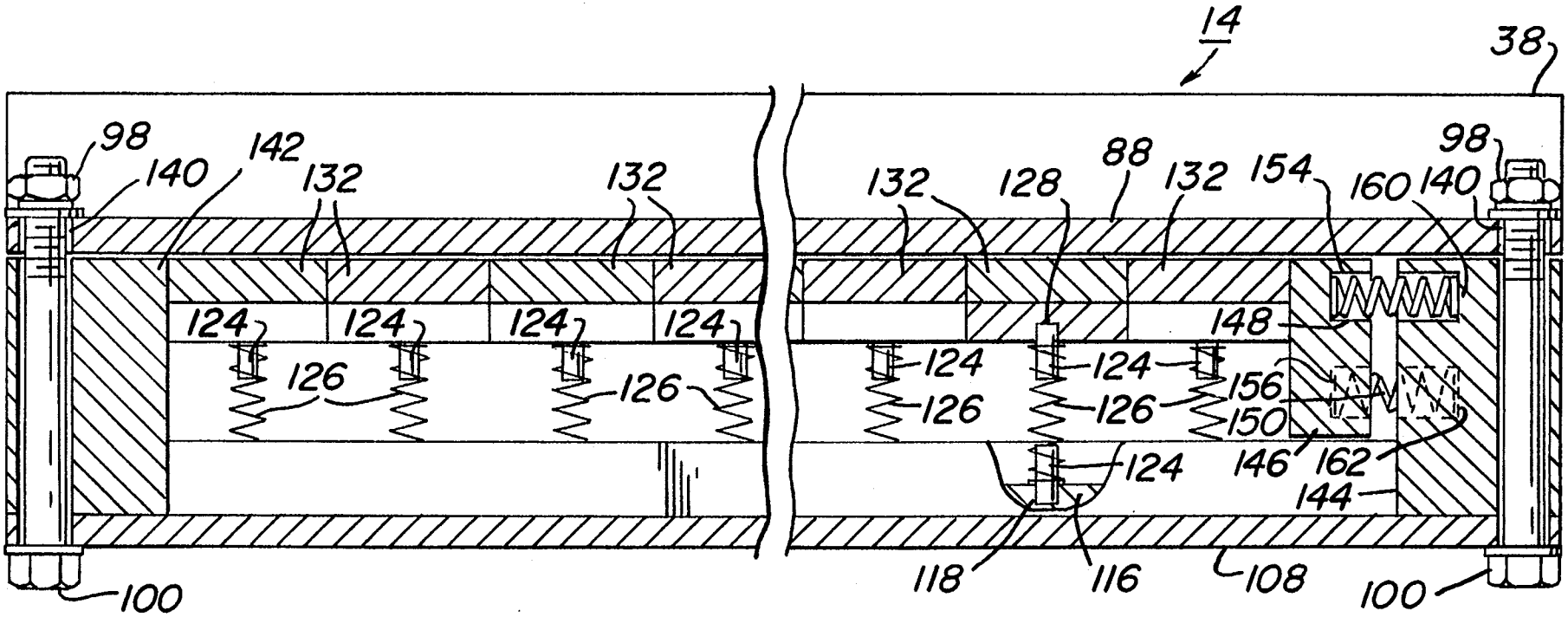
FIG. 11 illustrates the details of a mechanism, having compression springs, that allows for thermal expansion of the side-by-side arranged universal electrodes, while at the same time maintains side-by-side contact of the electrodes with each other so as to provide for the proper corona discharge for the non-conductive or conductive material being treated.
Figure 12:
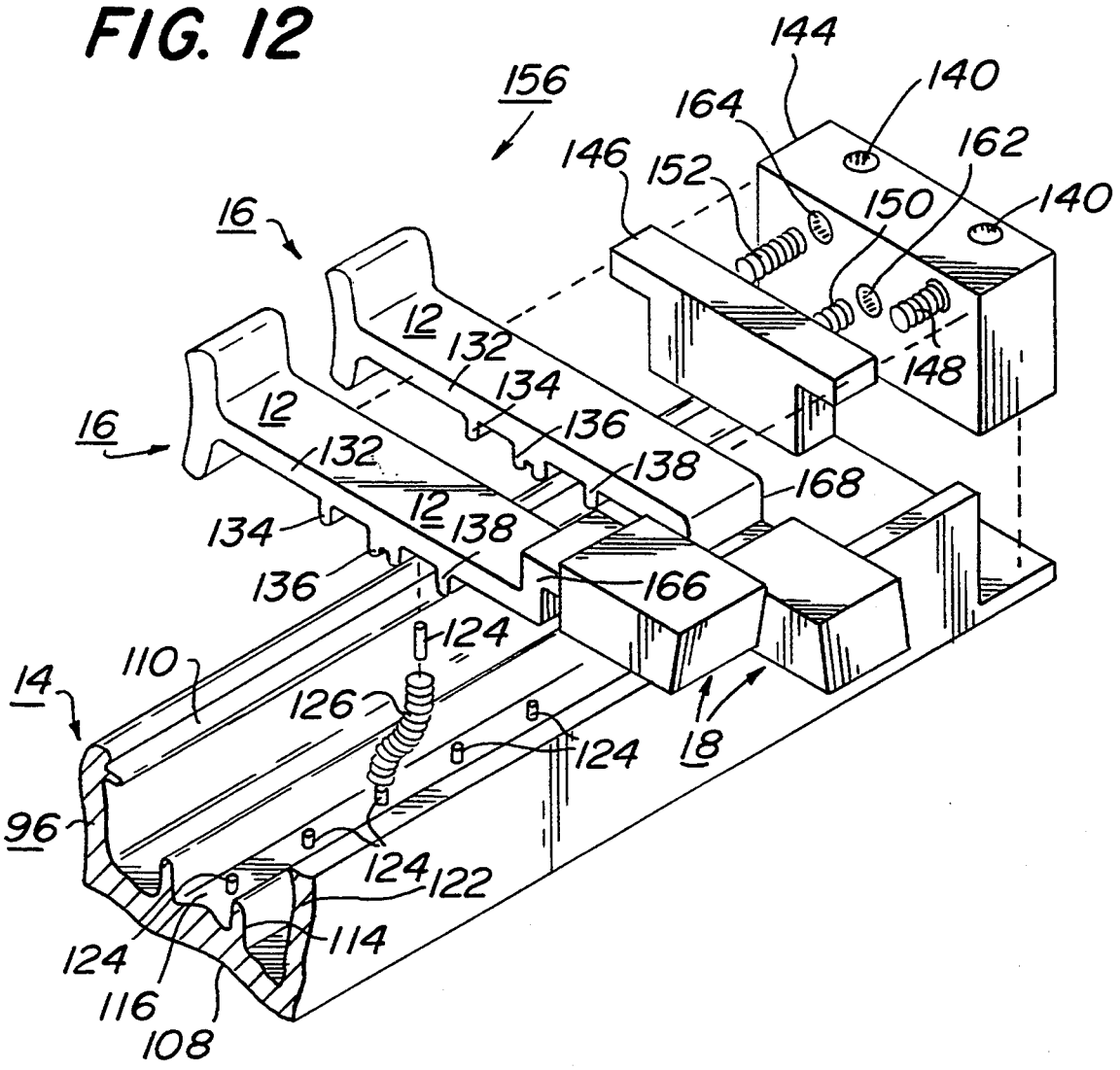
FIG. 12 is an exploded perspective view, partially in section, showing some of the universal electrodes arranged within the frame member.

The frame member 14, as is further described with reference to FIGS. 10–12, is an assembly wherein one of its components has three flanges 34, 36 and 38. Further, the frame member 14, when considered as including the arranged one or more universal electrodes, has a pivot point 40 about which the frame member 14 pivots. The pivot point 40 is of particular importance to the present invention and is parallel to and spaced apart, by a predetermined amount, from axis 42 of the rotating electrode 20. The pivot point 40 is located along a reference line 44 which is perpendicular to axis 42 and which longitudinally runs along the universal electrode and bisects electrode 16 as well as being equally spaced from the two side-by-side electrodes 18. As seen in FIG. 1, the pivot point 40 is also defined by a first predetermined distance 46 measured downward (as viewed in FIG. 1)

from a corner 48 of an edge 50 of frame 14 and also with respect to the reference line 44. Further, the pivot point 40 is still further defined by a second predetermined distance 52 measured inward (as viewed in FIG. 1) from the edge 50 to the reference line 44.

As will be further described, pivotable frame member 14 allows both electrode 16 and electrode 18 to be moved with respect to electrode 20 so as to vary and adjust a predetermined treatment gap 54. For the arrangement shown in FIG. 1, this gap 54 is between the electrode 16 and the rotating electrode 20. The frame member 14 further comprises connector means 56 having electrically mating members which maintain the electrical connections between the power supply 22 and the one or more universal electrodes 12 before, during and after the pivoting action of frame member 14.

The rotating electrode 20 generally comprises a metallic roll journalled for rotation about its central axis 42 and electrically connected to system ground 58 which is at the same electrical potential as one side of the power source 22. The rotating electrode 20 preferably has an outer surface upon which is placed a coating 60 formed of a dielectric material, such as silicone rubber, ceramic, epoxy, or any other dielectric material capable of sustaining the voltage levels and thermal stresses involved in corona discharge treatment. The rotating electrode 20 has a central shaft 62 which extends through a supporting member 64. A material 66 being treated passes over the outer surface of electrode 20.

The power supply 22 is of a conventional type commonly employed for corona discharge system and produces a corona effect on the material being treated. The power supply 22 has one of its ends connected, by way of conductive member 68, to a system ground and its other end connected, by way of conductive member 70, to the connector means 56. As those skilled in the art will appreciate, the power source 22 is operatively connected to rotating electrode 20 and to fixed electrodes 16 and 18 so that a corona discharge will appear between the one or more electrodes 16 and 18 and the electrode 20.

In operation, and with reference to FIG. 1, when a material 66 of a non-conductive type is selected to be treated, it is passed between the one or more electrodes 16 and the rotating electrode 20. When the power source 22 is energized, a high voltage electrostatic field exists between the electrode 16 and the grounded rotating electrode 20, with both the non-conductive material 66 and the dielectric non-conductive coating 60 interposed therebetween, so as to create a corona discharge effect for the treatment of the non-conductive material 66.

Figure 2:
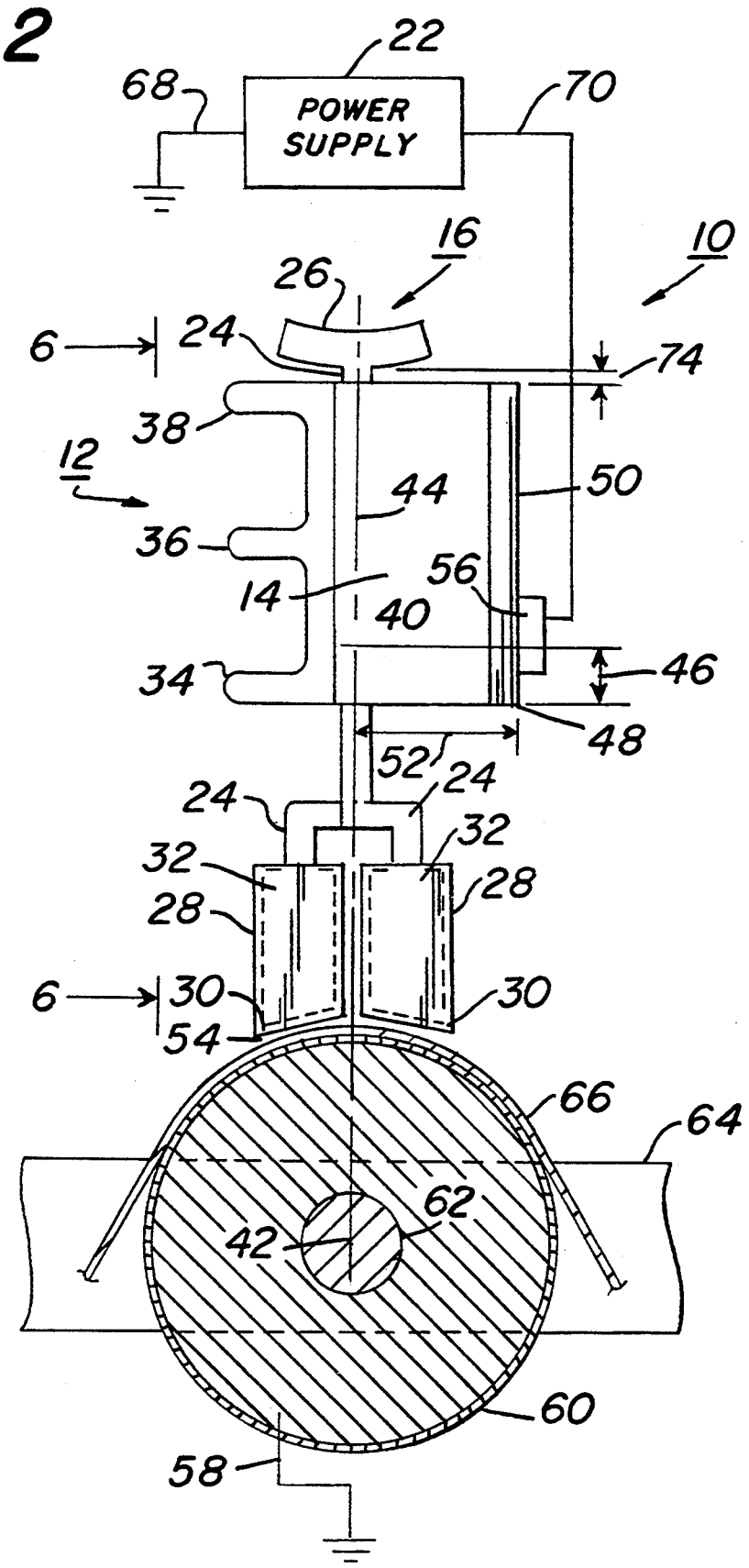
FIG. 2 schematically illustrates the same universal electrodes of FIG. 1, but with the universal electrodes pivoted 180° from their position in FIG. 1 so as to be properly situated for the treatment of conductive material.

The corona discharge treatment of a conductive material 66 is described with reference to FIG. 2. FIG. 2 illustrates an arrangement of system 10 which is the same as FIG. 1, except that the universal electrode 12 is shown in its second position, wherein the side-by-side, staggered second electrodes 18 each have their operating face 30 positioned relative to the rotating electrode 20 so as to establish a gap 54 for the treatment of conductive material 66. The interconnection between the power source 22 and rotating electrode 20 is the same as that described for FIG. 1. Similarly, the interconnection between the power source 22 and universal electrodes 12 is the same as that of FIG. 1, except that for the embodiment of FIG. 2, electrodes 18 of the universal electrodes 12 are energized. The conductive material 66 is insulated from electrode 18 because the hollow insulating member 28 of electrode 18, in particular its non-conductive face portion 30, separates the electrically conductive portion 32 of electrode 18 from the electrically conductive material 66. Further, the conductive material 66 is insulated from the grounded and rotating electrode 20 by the dielectric coating 60.

In operation, and now with reference to FIG. 2, when it is desired to treat a material 66 of the conductive type, all that is necessary is that the conductive material 66 be passed between electrodes 18 and the rotating electrode 20 and, further, that the power source 22 be energized. This establishes a high voltage electrostatic field between the conductive members 32 of the side-by-side, staggered electrodes 18 and the grounded rotating electrode 20. This electrical field establishes the corona effect that provides the corona treatment of the conductive material 66.

It should now be appreciated that the present invention makes available universal electrodes each of which provides for the corona discharge surface treatment by the use of electrode 18 that is particularly suited for the treatment of conductive material, while this same universal electrode also provides for the same treatment of non-conductive material by the use of electrode 16 that is particularly suited therefor.

The transition between the arrangements of FIGS. 1 and 2, in particular, the movement of universal electrode 12 from its first position for treating non-conductive material to its second position for treating conductive material, is easily accomplished, and is described first with reference back to FIGS. 1 and 2. FIG. 1 shows the electrode 16 in its operative position with respect to electrode 20, and extending downward (as viewed in FIG. 1) from frame 14 by a distance 72. Conversely, FIG. 2 shows the electrode 16 in its non-operative position, with respect to electrode 20, and extending upward (as viewed in FIG. 2) by a distance 74 which is less than distance 72. As will become apparent, the difference between these distances (72 and 74) is of importance in maintaining the same gap 54 when changing from the arrangement of FIG. 1 to the arrangement of FIG. 2. Further, although not shown for the sake of clarity in FIGS. 1 and 2, the electrode 18 has distances that correspond to distances 72 and 74 and which respectively correspond to the operative and non-operative positions of electrode 18. Further details of the transition between the arrangements of FIGS. 1 and 2 are described with reference to FIG. 3.

Figure 3:
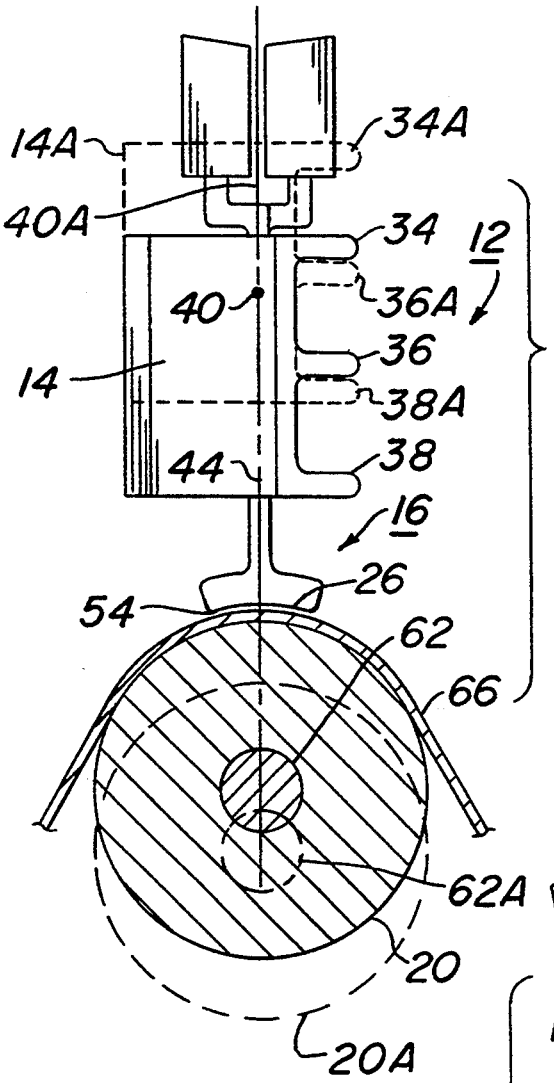
FIG. 3 illustrates alternative embodiments that allow for the displacement of the universal electrodes or the rotating electrode relative to each other so that the frame member holding and supporting the universal electrodes may be pivoted.

FIG. 3 is similar to FIG. 1 except that, for the sake of clarity, it does not show the power supply 22, the coating 60 of electrode 20, the support member 64, nor any of the dimensional distances; e.g., reference numbers 46, 48 and 50. FIG. 3 illustrates the operative positions of both the first electrode 16 and the rotating electrode 20, and also the retracted positions of the rotating electrode 20 and the frame 14. For such illustrations, FIG. 3 uses a solid representation and the reference numbers of FIG. 1 to indicate the operative positions of electrodes 16 and 20 and, conversely, uses the phantom representation and the letter "A" in conjunction with the reference numbers of FIG. 1, for example, 14A, 20A, 34A, 36A, 38A and 40A, to indicate the retracted positions of the electrode 20 and the frame 14. FIG. 3 further illustrates that either the frame 14 may be retracted away from the electrode 20 or, conversely, that the electrode 20 may be retracted away from the frame 14.

In operation, one or more universal electrodes 12 are arranged within the frame member 14 so that all of the universal electrodes 12 of system 10 are pivoted at the same time the single frame 14 pivots. The electrodes 16 may be directed to their retracted position by moving frame member 14 upward, as shown in FIG. 3, and away from the electrode 20. The upward movement of frame 14 carries along with it all of the universal electrodes 12. Further, the upward movement of frame 14 moves the pivot point of frame 14 from location 40 to location 40A both shown in FIG. 3.

For the retraction of the single electrode 20, the support member 64 (see FIG. 1) may be provided with appropriate means so as to be moved away from the frame 14, more particularly away from electrodes 16. The movement of support member 64 carries along with it electrode 20. As shown in FIG. 3, such movement is indicated by the shaft 62 being moved from the location, occupied by reference number 62, to the location occupied by reference number 62A. Similarly, the retracted position of the electrode 20 is shown in FIG. 3 with the phantom representation 20A of the electrode extending below the solid representation of electrode 20. The non-retracted (operative) and retracted (non-operative) positions of the universal electrodes 12 may be most easily seen in FIG. 3 by comparing the positions of flanges 34, 36 and 38 of frame 14 against those indicated as flanges 34A, 36A and 38A.

The pivoting of frame 14 is accomplished by pivoting frame 14 around pivot point 40. This may be accomplished in any appropriate manner to those skilled in the art. It is only important that the position of the frame member 14 be maintained relative to the electrode 20. So long as the relative position of the frame 14 is maintained with respect to electrode 20 while it is being pivoted 180° and the final position (180°) of frame 14 is the same as the initial position (0°) of frame 14, except for the reversal of locations of the electrodes 16 and 18, then the spacing of the gap 54, as is to be further described, is maintained and the corona discharge operation of the invention is properly performed. The appropriate means need only allow the frame 14 to be rotated about its pivot point (40 or 40A) by 180°, while still maintaining the overall location of frame 14 relative to electrode 20. Other examples of such pivoting mechanism for frame 14 would be readily apparent to those skilled in the art.

The pivot point 40 needs to be carefully selected so as to be along the reference line 44 and so as to be defined by distances 46 and 52 shown in both FIGS. 1 and 2. More particularly, the location of pivot point 40 needs to be selected so that the universal electrode 12 having one electrode 16 or 18 in its operative position; e.g., electrode 16 of FIG. 1 positioned opposed to electrode 20, may be pivoted 180°, thereby, allowing its other electrode; e.g., 18 to be positioned opposed to electrode 20. Furthermore, once such 180° pivoting has been accomplished, the proper selection of pivot point 40 now allows the electrode 16 (shown in FIG. 1 as separated from frame 14 by a distance 72) to be pushed inward by a predetermined distance toward frame 14 (such as a predetermined distance is shown in FIG. 2 by the obtainment of a distance 74), thereby, causing the electrode 18, located opposite to electrode 16 which is pushed, to obtain its operative position relative to electrode 20 and also to be separated therefrom by the gap 54 as shown in FIG. 2.

Figure 4A:
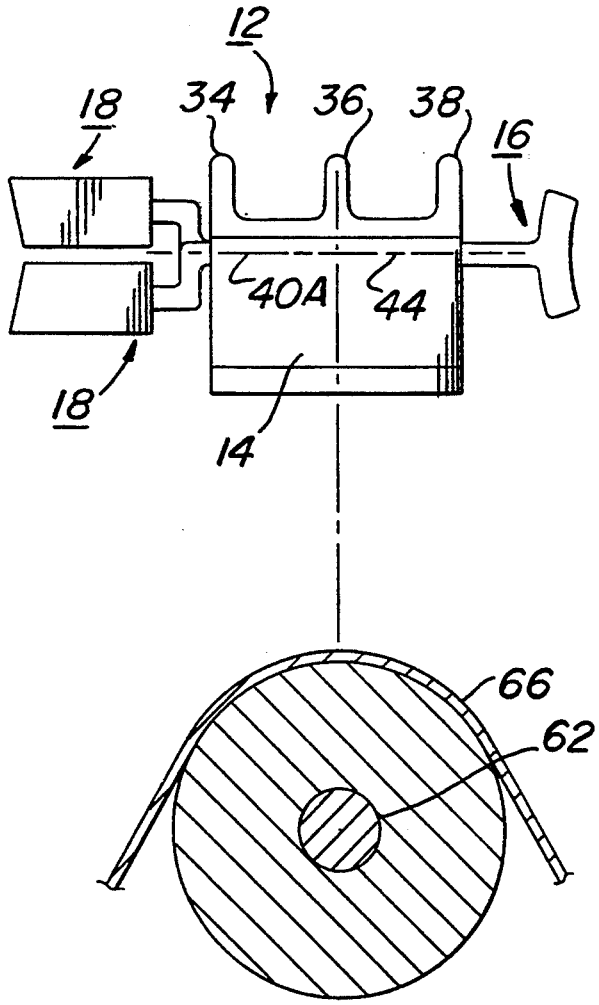
FIG. 4 is composed of FIGS. 4A, 4B and 4C, respectively, showing the pivoting of the frame member supporting and rotating the universal electrodes by 90°, 180° and 270° relative to the position shown in FIG. 1.
Figure 4B:
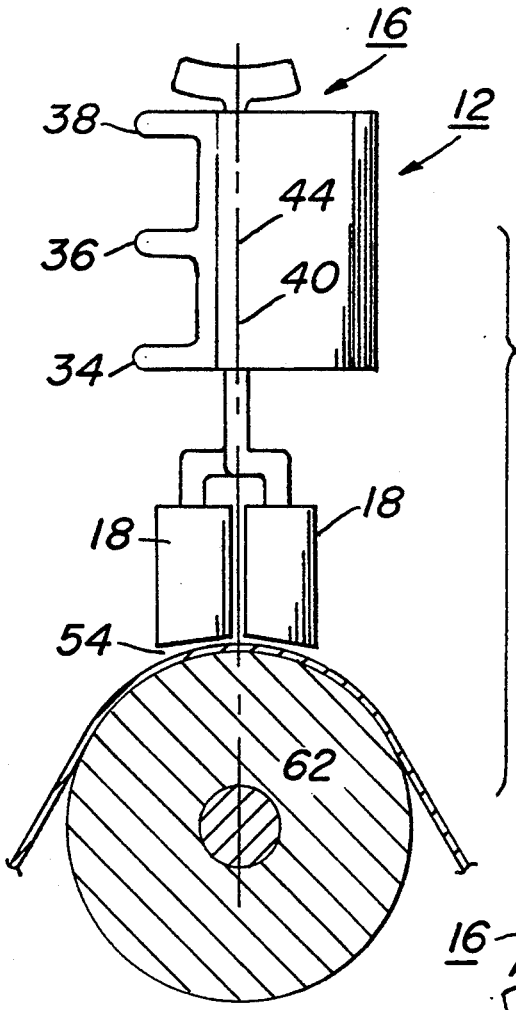
Figure 4C:
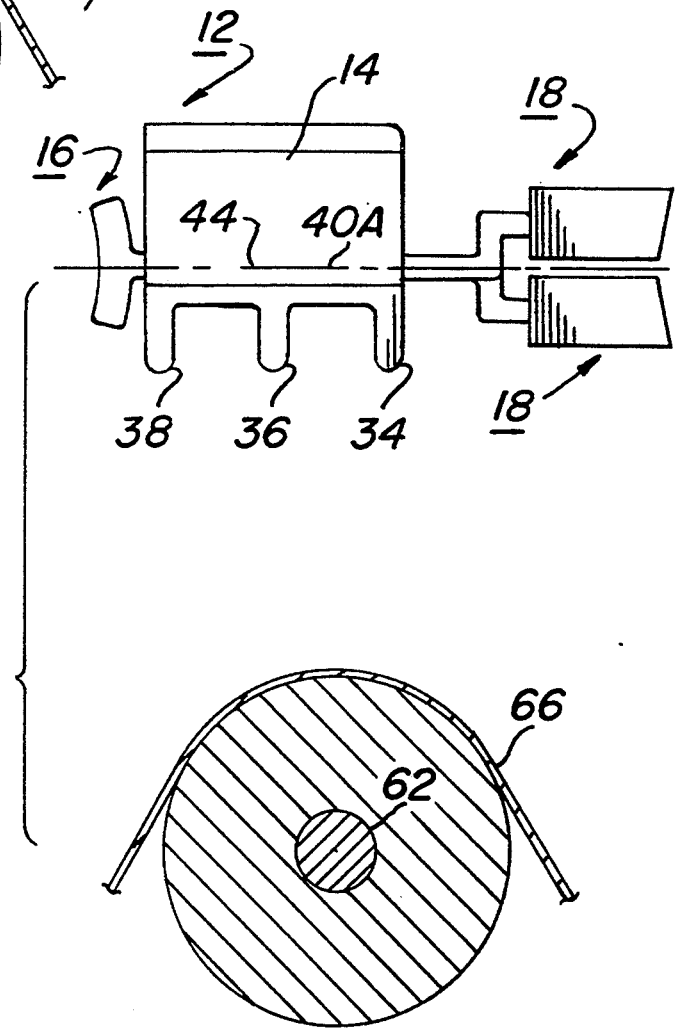

The pivoting of the frame 14, which carries along with it the universal electrode 12, may be described with reference to FIGS. 4A, 4B, and 4C. FIGS. 4A, 4B, and 4C illustrate further details of the embodiment of FIG. 3 in which the frame 14 is moved to position 40A for its pivoting whereas electrode 20 remains in its operative position. However, it should be recognized that the reverse procedure is equally applicable. More particularly, electrode 20 may be moved away from universal electrode to provide enough clearance so that the frame 14 may be pivoted about pivot point 40. With respect to the illustrations of FIGS. 4A, 4B and 4C, it should be noted that the electrodes 16, in operation, are in alignment with each other so that only one electrode 16 is shown. However, electrodes 18, in operation, are staggered so that FIGS. 4A, 4B and 4C illustrate two of such electrodes 18.

FIG. 4A illustrates the horizontal position of the universal electrodes 12 after frame 14 has been moved to pivot point location 40A and then pivoted counterclockwise by 90°. FIG. 4B illustrates a second or vertical position of the universal electrodes 12 after they are subjected to an additional 90°, relative to the illustration of FIG. 4A, by being carried by frame 14 as the frame 14 is pivoted about pivot point location 40A, again, in a counterclockwise direction. However, it should be noticed that FIG. 4B illustrates the universal electrodes 12 as being in their second operative position as described with reference to FIG. 2 and illustrates such an operative position by showing location 40 for the pivot point of frame 14. To obtain that location 40, the frame 14 needs to be removed from its pivotable position and moved downward (as viewed in FIG. 4B) toward the non-retracted electrode 20. Furthermore, as previously mentioned, the electrode 16 also needs to be pushed downward so as to change its separation from frame 14 from distance 76 to distance 72. Such movement now places the electrodes 18 into their operative positions. FIG. 4C illustrates the position of the electrodes 12 after they have undergone an additional 90°, relative to FIG. 4B, of pivoting, again being carried by frame 14. However, it should be noted that the universal electrodes 12 of FIG. 4C are carried by frame 14 having its pivot point illustrated at location 40A which is indicative that the frame 14 is first moved to its pivotable position (location 40A) before it is pivoted.

The frame 14, carrying with it the universal electrodes 12, is provided with appropriate means so that it may be first released from its locked location shown at 40, moved to location 40A, held in place at location 40A to allow for pivoting by a desired amount, and then released from at location 40A and moved back to and again locked in its operative position corresponding to that shown as reference number 40. Similarly, for the embodiment in which the electrode 20 is retracted to allow frame 14 to be pivoted about pivot 40, appropriate means are provided for the releasability and lockability of frame 14 to and about pivot point 40. Moreover, as will be apparent to those skilled in the art, the frame 14 for either of these embodiments may be provided with appropriate means so that the position of frame 14, carrying the plurality of universal electrodes 12, may be moved toward and away from the electrode 20 so that the gap 54 may be correspondingly adjusted to accommodate for various thicknesses of the material 66 being treated. Variations in the thicknesses of material 66 necessitates this adjustment so that the predetermined treatment gap 54 may be maintained in order to provide proper corona discharge treatment.

The pivot points locations 40 and 40A are both measured relative to the rotating electrode 20 and are both along reference line 44. These characteristics are important because these relationships allow for the universal electrodes 12 to be pivoted by 180° from their first position illustrated in FIG. 1 to their second position illustrated in FIG. 2, without causing any change to the predetermined treatment gap 54. More particularly, so long as the pivot point locations 40 and 40A are substantially maintained relative to rotating electrode 20 and so long as the pivoting of universal electrodes 12 is substantially confined to 180°, then the predetermined treatment gap 54 of FIG. 1 is substantially the same as the predetermined treatment gap 54 of FIG. 2.

It should now be appreciated that the present invention provides for universal electrodes 12, being carried by frame 14, that are easily retracted and easily pivoted so as to provide two different types of electrodes 16 and 18, each of which is particularly suited for the corona discharge treatment of non-conductive and conductive materials, respectively. The frame 14 is pivotable by 180° and its relative position with respect to the electrode 20 is maintained. Moreover, the frame 14 is pivotable by this 180° while the defined gap 54 is maintained after the selectably positioning of the first and second electrodes into their operative positions. In addition to being easily pivotable, the frame 14 may be easily moved toward and away from electrode 20 so as to allow for treatment gap adjustments to accommodate different thicknesses of material 66. Moreover, each of the one or more universal electrodes 12 may be individually positioned or retracted so as to accommodate different widths of the conductive or non-conductive material 66. The accommodation of the different widths of non-conductive material 66 may be easily understood with reference to FIG. 5, which is a view taken along line 5—5 of FIG. 1.

Figure 5:
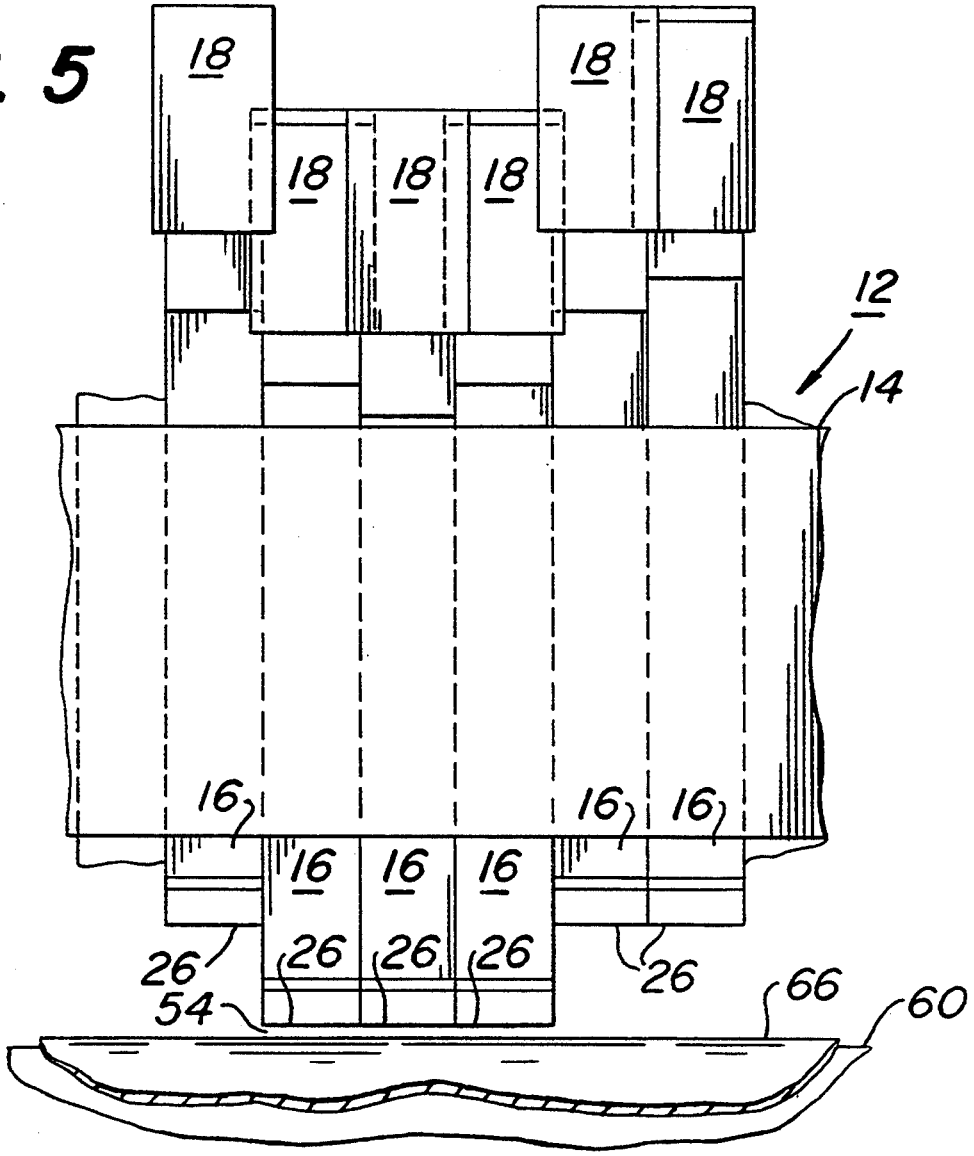
FIG. 5 is a side view, taken along line 5—5 of FIG. 1, of a plurality of universal electrodes situated to treat non-conductive materials.

FIG. 5 is a side view of the one or more electrodes 12 situated for the treatment of non-conductive material 66. FIG. 5 illustrates such a plurality of universal electrodes 12 all housed within the frame 14 in a side-by-side, abutting manner, having their first electrodes 16 in their operative position facing the non-conductive material 66 so as to obtain the predetermined treatment gap 54 and having their second electrodes 18 in their non-operative position. Each of tile electrodes 12 are separately positionable relative to non-conductive or conductive material 66 in a manner to be described hereinafter with reference to FIG. 10.

FIG. 5, exaggerated for illustration purposes only, shows three universal electrodes 12, in particular, the faces 26 of the first electrodes 16 adjusted to have a close operative relationship with the non-conductive material 66. For such an illustration, the width of material 66 being treated corresponds to three times the area covered by each of the circular faces of the first electrode 16 of the universal electrodes 12. The arrangement of the second electrodes 18 for treating conductive material 66 is described with reference to FIG. 6, which is a view taken along line 6—6 of FIG. 2.

Figure 6:
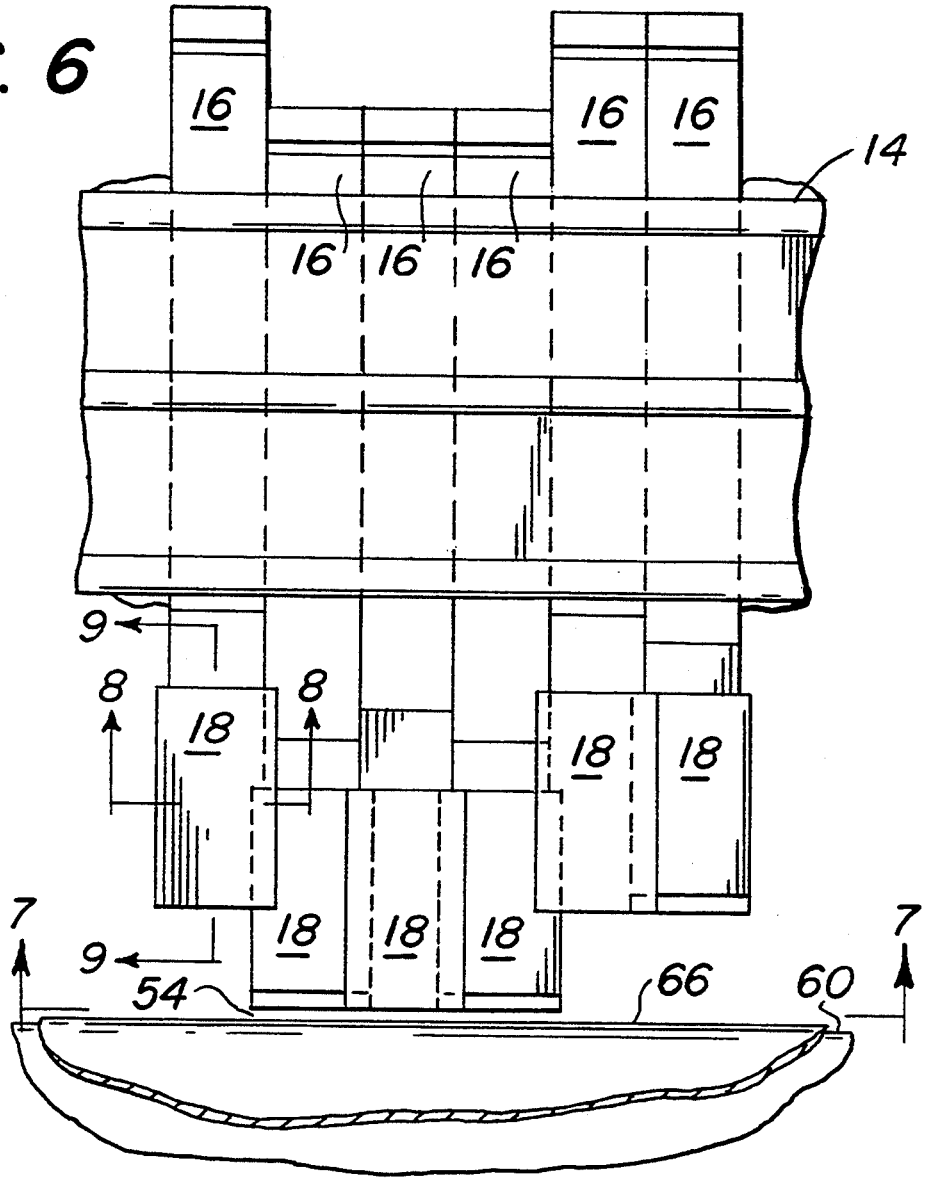
FIG. 6 is a side view, taken along line 6—6 of FIG. 2, of the plurality of universal electrodes positioned in a side-by-side arrangement for the treatment of conductive materials.

FIG. 6 is a side view of the one or more universal electrodes 12 located with frame member 14, in a side-by-side arrangement, with their second electrodes 18 in their operative positions for the treatment of conductive materials 66 and operatively arranged in a manner to obtain the predetermined treatment gap 54. The electrodes 18 are arranged in a side-by-side aligned manner to produce a spaced electrically insulated relationship with respect to each other and so that their conductive members 32 continuously span the width of material 66 being treated. Such an aligned arrangement is described with reference to FIG. 7, which is a view taken along line 7—7 of FIG. 6.

Figure 7:
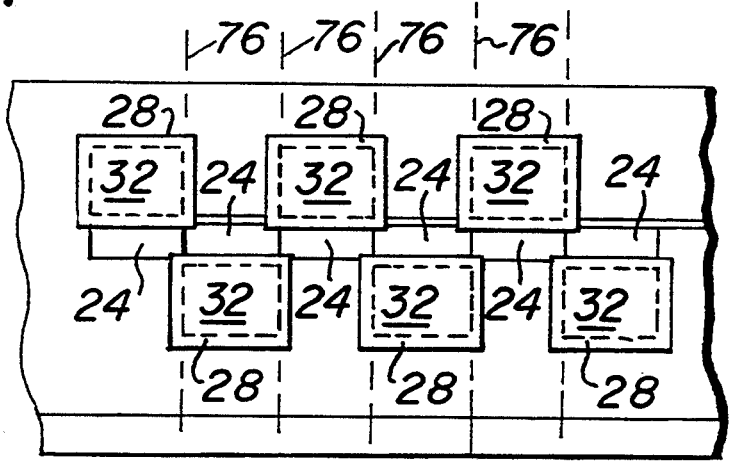
FIG. 7 is a bottom view, taken along line 7—7 of FIG. 6, of the universal electrodes of FIG. 6, arranged for the treatment of conductive materials.

In general, FIG. 7 illustrates the following two features: (1) a staggered arrangement of the second electrodes 18 as easily seen in FIG. 7, and (2) a continuous arrangement of the conductive portions 32 of electrodes 18. As seen in FIG. 7, a plurality of reference lines 76 are drawn so as to representatively show the alignment between each of the conductive portions 32 (shown by being enclosed in phantom) of the side-by-side electrodes 18. The electrodes 18 are arranged in this manner so that their conductive portions 32 provide a continuous path which completely and advantageously covers the width of the material 66 desired to receive corona discharge treatment.

It will now be appreciated that the present invention provides arrays of electrodes 16 or 18 that may be arranged so as to provide for width adjustability of the non-conductive or the conductive materials being treated.

Figure 8:
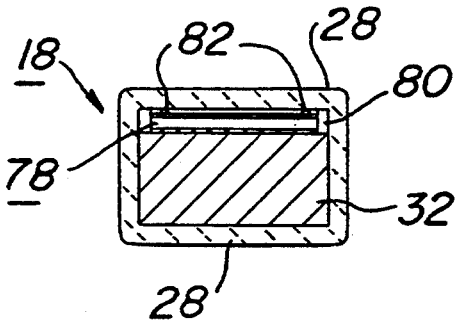
FIGS. 8 and 9 are sectional views respectively taken along line 8—8 and line 9—9 of FIG. 6, both showing further details of a portion of the second electrode of the universal electrode used for the treatment of conductive material.
Figure 9:
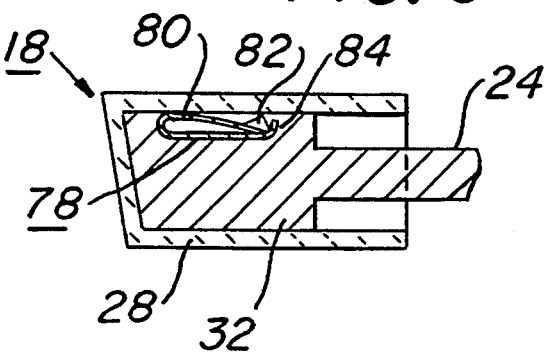

Further details of electrodes 18 are described with reference to FIGS. 8 and 9 which are respective views taken along line 8—8 and line 9—9 of FIG. 6, and with the view of line 9—9 being rotated 90° in a clockwise manner as shown in FIG. 9.

FIG. 8 illustrates electrode 18 as having a clip member 78 lodged in a cutout 80 of conductive member 32. The clip member 78 has barbs 82 which engage the housing 28 and one of which is shown in more detail in FIG. 9.

FIG. 9 illustrates a barb 82 located near an upturned portion 84 of the clip member 78. Clip member 78 preferably comprises a spring material so that the barbs 82 serve as sharp projections that extend into the housing 28 and prevent any easy extraction of the conductive member 32 from the housing 28. Although a spring-like clip member 78 having barbs 82 has been described, any device that grips, clamps or hooks into housing 28 may serve as the clip engagement means of the present invention. The clip member 78 is further illustrated in FIG. 10.

FIG. 10, in its lower portion, illustrates the clip member 78 as being held within the conductive member 32 and with conductive member 32 having a leg that is spaced apart from the tipper portion of housing 28 by regions 86 and 88. FIG. 10, in its upper portion, also illustrates a universal electrode 12 as being located within frame 14 but separated therefrom by regions 90 and 92.

The frame 14 is preferably an aluminum material and comprises a support channel 94 and a channel extension 96 that are detachably connected together by suitable means, such as a nut 98 and bolt 100. The support channel 94 is preferably an E-shaped member having a base portion 102 and having the three flange portions 34, 36 and 38 previously discussed. The support channel 94 does not come into direct contact with electrode 12, but rather, includes members 104 and 106, preferably of a teflon material, that allow the electrode 12 to be guided along the support channel 94. These teflon member 104 and 106 allow for such guiding even when the surface temperature of electrode 12 is elevated during its operational usage.

As seen in FIG. 10, the channel extrusion 96 comprises a base portion 108; a rail portion 110 that also serves as a stop, to be described, for electrode 12; two extrusions 112 and 114 extending out from a channel portion 114 having a cutout 118 centrally located therein; a projection portion 120; and a side portion 122 which also serves as a stop, to be described, for the electrode 12. A pin 124 is inserted into cutout 118 and about which pin 124 is placed one end of a spring 126 which has its other end placed about another pin 124 lodged in a channel 128 of the universal electrode 12. The spring 126 is arranged to move with respect to an axis 130 which corresponds to the approximate center of the frame 14. The universal electrode 12 has a center region 132 from which extends protrusions 134, 136 and 138.

The spring 126, situated within frame 14, serves a well-known over-center bistable mechanism. The over-center spring bistable mechanism 126 functions such that as the universal electrode 12, in particular protrusion 136, is moved toward and then reaches the center position of the frame 14, in particular center axis 130, the spring mechanism 126 further assists that movement of the universal electrode 12 so that it reaches either of its operating position in a snap-like manner. The spring mechanism 126 is used by the frame 14 so that either the first electrode 16 or the second electrode 18, both of electrode 12, may be accurately snapped into or out of its operating position. FIG. 10 illustrates the electrode 16 in its non-operative position as being spaced from frame 14 by the distance 74 (previously discussed with reference to FIG. 2) and also electrode 16 in its operative position as being spaced from frame 14 by the distance 72 (previously discussed with reference to FIG. 1). For illustration only purposes, the electrode 18 of FIG. 10 is shown in its operative position by its solid representation and the electrode 16 is shown in its retracted (non-operative) by its solid representation. Conversely, the operative position of electrode 16 and the non-operative position of electrode 18 are shown in FIG. 10 by the use of phantom representations (16A and 18A, respectively).

In operation, and with first reference to the solid representation of the second electrode 18 of FIG. 10, as the universal electrode 12 is moved so that its central protrusion 136 approaches center line 130, the spring 126 imparts a force to the universal electrodes 12 which assists in the further upward movement of electrode 12 so that it is forced upward until its protrusion 134 snaps against rail 110 which serves as a stop thereto. Upon such contact (indicated by the location of protrusion 134A), the electrode 16 is positioned into its operative relationship for the treatment of conductive material 66. The universal electrode 12 may be downward in a similar manner, except that spring 126 imparts a force to electrode 12 as it approaches the center axis 130 which assists in the further downward movement of universal electrode 12 causing its extension 138 to snap against side portion 122 which serves as a stop thereto.

The spacing between protrusion 136 (in particular its channel 128) and protrusion 134 establishes the range of the upward movement of electrode 12 (as viewed in FIG. 10) and, conversely, the spacing between protrusions 136 (again, in particular its channel 128) and protrusion 138 establishes the range of the downward movement of electrode 12 (again as viewed in FIG. 10). These upward and downward movements in turn establish the distances 74 and 72 associated with electrode 16 (and also the corresponding distances (not illustrated) for electrode 18) which, in turn, respectively establish the non-operative and operative positions of electrode 16 (and, similarly, the corresponding distances for electrode 18 establish the non-operative and operative positions for electrode 18). Accordingly, the accurate control of the spacings between protrusions 134, 136 and 138 correspondingly provide for the accurate control of the operative and non-operative positions for both electrodes 16 and 18.

A further feature of the present invention that allows for the thermal expansion of the universal electrodes 12 is described with reference to FIG. 11. FIG. 11 illustrates the frame 14 as housing abutting universal electrodes 12. This abutting relationship is shown by the side-by-side regions 132 of the electrodes 12 being illustrated in cross-section. FIG. 11 further illustrates each of the universal electrodes 12 as having attached thereto pin 124 and spring 126. The attachment of pin 124 and spring 126 is further illustrated, partially in section, by pin 124 of universal electrodes 12 being lodged in its channel 128 and by pin 124 of the channel extension 96 being lodged in its cutout 118. Further, FIG. 11 illustrates the opposite ends of the frame member 14 as being detachably coupled by the arrangement of nut 98 and bolt 100, inserted into appropriate apertures 140.

One end of the arrangement of the abutting 12 universal electrodes 12 is rigidly fixed by means of one end plate 142, whereas the other end of the arrangement of the abutting universal electrodes 12 is not rigidly fixed, but rather, is allowed to expand outward in a sideward manner as viewed in FIG. 11. This outward expansion is provided by means of another end plate 144 being coupled to a spring block 146 by means of compression springs 148, 150 and 152 (not shown in FIG. 11, but shown in FIG. 12 to be described). The compression springs 148, 150 and 152 have one of their ends inserted into openings 154, 156 and 158 (not shown) of spring block 146 and their other end inserted into openings 160, 162 and 164 (not shown) of the end plate 144.

The compression springs 148, 150 and 152 provide at least two important features for the universal electrodes 12. The first feature is that they provide for an inwardly-extending force (as viewed in FIG. 11), caused by their inherent spring actions, which keeps the universal electrodes 12 abutting against one another so that there is no space or void across the area of the material 66 being treated by the universal electrodes 12. The second feature is that these compression springs compensate for the normally occurring thermal expansion of the universal electrodes, created by their temperature being elevated during their operation, because they allow themselves to be depressed in response to the outward expansion of the electrodes (as viewed in FIG. 11), while at the same time supply a force to keep the universal electrodes abutting against one another so as to provide for the proper corona discharge across the area of the conductive and non-conductive materials being treated. Accordingly, compression springs 148, 150 and 152 in cooperation with spring block 146 and end plate 144 provide the means for maintaining an abutting relationship of the first and second electrode means 16 and 18 even while the temperature of each of the first and second electrodes 16 and 18 is elevated during its operation.

The compression springs, as well as other elements shown in FIG. 11, are further illustrated in FIG. 12. FIG. 12 is an exploded perspective view showing the arrangement of two of the universal electrodes 12 onto the frame 14. For clarity purposes, the support channel 94 of the frame member 14 is not shown in FIG. 12 so that the arrangement of the universal electrodes 12 within frame 14 may be more clearly illustrated.

As seen in FIG. 12 in an exemplary manner, an individual overcenter bilateral spring mechanism 126 is provided for each separate universal electrodes 12 and has one of its ends inserted into the pin 124 that is positionable in the channel 128 of electrode 12, and its other end inserted into pin 124 which is positionable into the opening 118 (now shown) of channel 116 of the channel extension 96. Further, as seen in FIG. 12, each of the universal electrodes 12 have protrusions 134 and 138 that are positionable within frame 14 so as to be able to respectively engage rail 110 and side portion 122 during the extremes of the range of the movement of the electrodes 12.

FIG. 12 illustrates two side-by-side arranged universal electrodes 12 each having the second electrode 18 at one of its ends and with the pair of the illustrated electrodes 18 having an upward (as viewed in FIG. 12) bend 166 in conductive member 24 and a downward (also as viewed in FIG. 12) bend 168 in conductive member 24. In the manufacture of the universal electrodes 12, each universal electrode has an upward bend 154 and a downward bend 168, but one of the bends 166 or 168 is removed therefrom so that the staggered arrangement of the electrodes 12, as shown in FIG. 12, may be obtainable.

It should now be appreciated that the practice of the present invention provides for a frame member 14 which has arranged thereon a plurality of universal electrodes and which frame member 14 is easily pivoted so that either the first or second electrodes of the plurality of universal electrodes may be arranged in an operative relationship with the non-conductive or conductive material being treated.

The present invention may be embodied in other specific forms without departing from the spirit or essential attributes thereof and, accordingly, reference should be made to the appended claims, rather than to the foregoing specification, as indicating the scope of the invention.

We claim:

1. An electrode for a corona discharge device, comprising first electrode means configured for corona discharge treatment of non-conductive materials and second electrode means configured for corona discharge treatment of conductive materials, said first and second electrode means being housed in a common support means having a pivot point about which the common support means is pivotable for selectably positioning a selected one of the first and second electrodes in corona discharge treatment relation to a material to be treated by the electrode.

2. An electrode for a corona discharge device according to claim 1, wherein said first electrode comprises a conductive member that includes a conductive operating face.

3. An electrode for a corona discharge device according to claim 1, wherein said second electrode comprises a hollow insulating member having a conductive member disposed therein.

4. An electrode for a corona discharge device according to claim 3 further comprising clip means disposed within the conductive member and having engagement means that prevents said conductive member from being easily separated from said hollow insulating member.

5. In a corona discharge system for corona discharge treatment of continuous webs of film materials, the system having at least one generally cylindrical electrode mounted for rotation about a central axis thereof, a pivotable but fixed electrode assembly comprising:

first electrode means configured for corona discharge treatment of non-conductive film materials and second electrode means configured for corona discharge treatment of conductive film materials, and common support means for the first and second electrode means, the common support means having a pivot point disposed parallel to and spaced apart from the central axis of the generally cylindrical electrode, the common support means being pivotable about the pivot point for selectably positioning a selected one of the first and second electrodes in spaced corona discharge treatment relation to the generally cylindrical electrode, thereby defining a gap between the generally cylindrical electrode and the selected one of the first and second electrode means for the passage of materials to be treated between the generally cylindrical electrode and the selected one of the first and second electrode means.

6. In a corona discharge surface treatment system according to claim 5, wherein said generally cylindrical electrode has an outer face with a dielectric coating thereon.

7. In a corona discharge surface treatment system according to claim 5, wherein said first electrode means comprises a plurality of first electrodes each of which comprises a continuous conductive member that includes a conductive operating face.

8. In a corona discharge surface treatment system according to claim 7, wherein said plurality of first electrodes are arranged in a side-by-side manner with adjacent electrodes being in contact with each other.

9. In a corona discharge surface treatment system according to claim 5, wherein said second electrode means comprises a plurality of second electrodes each of which comprises a hollow insulating member having a conductive member disposed therein.

10. In a corona discharge surface treatment system according to claim 9 further comprising clip means disposed within the conductive member and having engagement means that prevents said conductive member from being easily separated from said hollow insulating member.

11. In a corona discharge surface treatment system according to claim 9, wherein said plurality of second electrodes comprises a side-by-side arrangement of electrodes mounted in a spaced electrically insulated relationship with respect to each other.

12. In a corona discharge surface treatment system according to claim 11, wherein said plurality of second electrodes each have their side-by-side hollow insulating member arranged in an overlapping manner so that their disposed side-by-side conductive members are aligned with respect to each other.

13. In a corona discharge surface treatment system according to claim 5, wherein first and second electrodes are interconnected by a common conductive member and wherein said system further comprises an over-center spring bilateral mechanism having one end connected to said common conductive member and its other end connected to said common support means.

14. In a corona discharge surface treatment system according to claim 5, further comprising means for retracting the rotating electrode away from said first and second electrode means.

15. In a corona discharge surface treating system according to claim 5, wherein said pivot point is located on said common support means so that said common support means is capable of being pivotable 180° while its relative position with respect to said generally cylindrical electrode is maintained.

16. In a corona discharge surface treating system according to claim 15, wherein said pivot point is further located on said common support means so that said common support means is capable of being pivotable by said 180° and said defined gap is maintained after said selectably position of said selected one of said first and second electrodes.

17. In a corona discharge surface treating system according to claim 5, wherein said common support means further comprises means for maintaining an abutting relationship of said first and second electrode means even while the temperature of each of said first and second electrode means is elevated during its operation.

18. Corona discharge apparatus, comprising:

(a) at least one generally cylindrical electrode mounted for rotation about a central axis thereof, (b) a pivotable fixed electrode assembly comprising:

(i) first electrode means configured for corona discharge treatment of non-conductive materials and second electrode means configured for corona discharge treatment of conductive materials;

(ii) common support means for the first and second electrode means, the common support means having a pivot point disposed parallel to and spaced apart from the central axis of the generally cylindrical electrode, the common support means being pivotable about the pivot point for selectably positioning a selected one of the first and second electrodes in corona discharge treatment relation to the generally cylindrical electrode;

(c) means for relatively positioning the generally cylindrical electrode and the selected one of the first and second electrode means to define a gap between the generally cylindrical electrode and the selected one of the first and second electrode means for the passage of materials to be treated between the generally cylindrical electrode and the selected one of the first and second electrode means, and (d) power supply means connected to the generally cylindrical electrode and the selected one of the first and second electrode means for applying a high voltage electric field across the gap.

19. A corona discharge surface treating apparatus according to claim 18, wherein said generally cylindrical electrode has an outer face with a dielectric coating thereon.

20. A corona discharge surface treating apparatus according to claim 18, wherein said first electrode means comprises a plurality of first electrodes each of which comprises a solid conductive member that includes a conductive operating face.

21. A corona discharge surface treating apparatus according to claim 20, wherein said plurality of first electrodes are arranged in a side-by-side manner with adjacent electrodes coming into contact with each other.

22. A corona discharge surface treating apparatus according to claim 18, wherein said second electrode means comprises a plurality of second electrodes each of which comprises a hollow insulating member having a conductive member disposed therein and having a front portion of a generally cylindrical shape.

23. A corona discharge surface treating apparatus according to claim 22 further comprising clip means disposed within the conductive member and having engagement means that prevents said conductive member from being easily separated from said hollow insulating member.

24. A corona discharge surface treating apparatus according to claim 23, wherein said plurality of second electrodes each have their side-by-side hollow insulating member arranged in an overlapping manner so that their disposed side-by-side conductive members are aligned with respect to each other.

25. A corona discharge surface treating apparatus according to claim 18, wherein said plurality of second electrodes comprises a side-by-side arrangement of electrodes mounted in a spaced electrically insulated relationship with respect to each other.

26. A corona discharge surface treating apparatus according to claim 18, wherein said first and second electrodes are interconnected by a common conductive member and wherein said apparatus further comprises an over-center spring bilateral mechanism having one end connected to said common conductive member and its other end connected to said common support means.

27. A corona discharge surface treating apparatus according to claim 18, further comprising means for retracting the rotating electrode away from said first and second electrode means.

28. A corona discharge surface treating apparatus according to claim 18, wherein said pivot point is located on said common support means so that said common support means is capable of being pivotable 180° while its relative position with respect to said generally cylindrical electrode is maintained.

29. A corona discharge surface treating apparatus according to claim 28, wherein said pivot point is further located on said common support means so that said common support means is capable of being pivotable by said 180° and said gap is maintained after said selectably positioning of said selected one of said first and second electrodes.

30. A corona discharge surface treating apparatus according to claim 18, wherein said common support means further comprises means for maintaining an abutting relationship of said first and second electrode means even while the temperature of each of said first and second electrode means is elevated during its operation.

31. A corona discharge surface treating system for treating conductive and non-conductive materials, comprising:

one or more universal electrodes each having a first electrode with an operating face used for treating non-conductive material and a second electrode having an operating face used for treating conductive material;

a common support means for said one of more universal electrodes having a pivot point and being pivotable so as to respectively match the operating faces of the first and second electrodes with the non-conductive and conductive type materials being treated;

a rotating electrode having an outer face upon which is placed one of said non-conductive and conductive materials which is to be treated, said rotating electrode mounted for rotation about an axis which is disposed parallel to and spaced apart from said axis of said support member, said rotating electrode located relative to said operating face of said one or more universal electrodes so as to provide a predetermined gap between the operating face of the one or more electrodes and the rotating electrode and through which gap the material to be treated is moved; and power supply means providing a high voltage field across said treatment gap.

32. A corona discharge surface treating system according to claim 31, wherein said outer face of said rotating electrode has a dielectric coating.

33. A corona discharge surface treating system according to claim 31, wherein each of said one or more electrodes having means to maintain electrical connections during its pivoting.

34. A corona discharge surface treating system according to claim 31, wherein each of said one or more first electrodes comprises a solid conductive member that includes said conductive operating face.

35. A corona discharge surface treating system according to claim 31, wherein said one or more first electrodes are arranged in a side-by-side manner with adjacent electrodes coming into contact with each other.

36. A corona discharge surface treating system according to claim 32, wherein each of said one or more second electrodes comprises a hollow insulating member having said conductive member disposed therein and having a front portion shaped to conform to said outer surface of said rotating electrode and serving as its said operating face.

37. A corona discharge surface treating system according to claim 36 further comprising clip means disposed within said conductive member and having engagement means that prevents said conductive member from being easily separated from said hollow insulating member.

38. A corona discharge surface treating system according to claim 36, wherein each of said one or more second electrodes comprises a side-by-side arrangement of electrodes mounted in a spaced electrically insulated relationship with respect to each other.

39. A corona discharge surface treating system according to claim 38, wherein said one or more second electrodes each have their side-by-side hollow insulated arranged in an overlapping manner so that their disposed side-by-side conductive members are aligned with respect to each other.

40. A corona discharge treating surface according to claim 31, wherein said first and second electrodes are interconnected by a common conductive member and wherein said system further comprising an over-center spring bilateral mechanism having one end connected to said common conductive member and its other end connected to said common support means.

41. A corona discharge surface treating system according to claim 31, further comprising means for retracting said rotating electrode away from said one or more universal electrodes.

42. A corona discharge surface treating system according to claim 31, wherein said pivot point is located on said common support means so that said common support means is capable of being pivotable 180° while its relative position with respect to said rotating electrode is maintained.

43. A corona discharge surface treating system according to claim 42, wherein said pivot point is further located on said common support means so that said common support means is capable of being pivotable by said 180° and said defined gap is maintained after said selectably positioning of said selected one of said first and second electrodes.

44. A corona discharge surface treating system according to claim 31, wherein said common support means further comprises means for maintaining an abutting relationship of said first and second electrode means even while the temperature of each of said first and second electrode means is elevated during its operation.

* * * * *